US011373581B2

(12) United States Patent
Hu et al.

(10) Patent No.: US 11,373,581 B2
(45) Date of Patent: Jun. 28, 2022

(54) DISPLAY PANEL, CODE READING METHOD AND COMPUTER READABLE STORAGE MEDIUM

(71) Applicants: HKC CORPORATION LIMITED, Shenzhen (CN); CHONGQING HKC OPTOELECTRONICS TECHNOLOGY CO., LTD., Chongqing (CN)

(72) Inventors: Yunchuan Hu, Shenzhen (CN); Wei Li, Shenzhen (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/239,619

(22) Filed: Apr. 25, 2021

(65) Prior Publication Data

US 2022/0036806 A1 Feb. 3, 2022

(30) Foreign Application Priority Data

Jul. 28, 2020 (CN) ..... 202010741309.1

(51) Int. Cl.
*G09G 3/20* (2006.01)
*G09G 5/00* (2006.01)

(52) U.S. Cl.
CPC ..... *G09G 3/2096* (2013.01); *G09G 5/006* (2013.01); *G09G 2310/08* (2013.01)

(58) Field of Classification Search
CPC ... G09G 3/2096; G09G 5/006; G09G 2310/08
See application file for complete search history.

(56) References Cited

U.S. PATENT DOCUMENTS

2020/0201617 A1* 6/2020 Park ..... G06F 3/0614
2020/0273390 A1* 8/2020 Dai ..... G09G 3/20

FOREIGN PATENT DOCUMENTS

CN 109388345 A 2/2019
CN 109410870 A 3/2019
JP H0764454 A 3/1995

OTHER PUBLICATIONS

First Office Action issued in counterpart Chinese Patent Application No. 202010741309.1, dated Feb. 19, 2021.

(Continued)

*Primary Examiner* — Towfiq Elahi
(74) *Attorney, Agent, or Firm* — Westbridge IP LLC

(57) ABSTRACT

The present disclosure discloses a codes reading method, the codes reading method is applied to the display panel, the storage area of the display panel stores the default codes and the same backup codes as the default codes, and the codes reading method includes the following steps: in responding to a determination that the timing controller is powered on, reading, by the timing controller, the default codes of the storage area; determining whether a read default codes are rewritten or not; in responding to a determination that the read default codes are rewritten, reading a backup codes of the storage area to take the read backup codes as the target codes; in responding to a determination that there is no rewriting of the read default codes, the read default codes are taken as the target codes. the present disclosure also discloses a display panel and a computer readable storage medium.

8 Claims, 4 Drawing Sheets

(56) References Cited

OTHER PUBLICATIONS

Second Office Action issued in counterpart Chinese Patent Application No. 202010741309.1, dated May 21, 2021.

* cited by examiner

DISPLAY PANEL, CODE READING METHOD AND COMPUTER READABLE STORAGE MEDIUM

CROSS REFERENCE TO RELATED APPLICATIONS

The present disclosure claims the priority to Chinese patent application No. 202010741309.1 which is entitled "DISPLAY PANEL, CODE READING METHOD AND COMPUTER READABLE STORAGE MEDIUM" and filed on Jul. 28, 2020, the entire contents of which is incorporated herein by reference.

TECHNICAL FIELD

The present disclosure relates to the technical field of display equipment, in particular to a display panel, a code reading method and a computer readable storage medium.

BACKGROUND

Code is generally stored in the EEPROM (Electrically Erasable Programmable Read Only Memory) of the display panel. The TCON (Timer Control Register) reads the codes from the EEPROM, if the codes are rewritten, it will cause the display panel to display abnormally.

SUMMARY

The main object of the present disclosure is to provide a display panel, a code reading method and a computer readable storage medium, aiming at solving the problem that the codes are rewritten and the display panel is abnormal.

In order to achieve the above object, the present disclosure provides a code reading method, the code reading method is applied to a display panel, a storage area of the display panel stores default codes and backup codes that are the same as the default codes, the code reading method includes the following steps:

in determination that a timing controller is powered on, reading, by the timing controller, the default codes of the storage area;

determining whether the default codes are rewritten or not;

in determination that the default codes are rewritten, reading the backup codes of the storage area to take the backup codes as target codes; and, in determination that there is no rewriting of the default codes, the default codes are taken as the target codes.

In one embodiment, after the step of reading the backup codes of the storage area, the method further includes:

correcting the default codes according to the backup codes.

In one embodiment, the step of correcting the default codes according to the backup codes includes:

overwriting the backup codes over the default codes.

In one embodiment, the code reading method of claim 2, the step of correcting the default codes according to the backup codes includes:

comparing the backup codes and the default codes to determine a rewritten codes segment of the default codes;

determining a correcting codes segment corresponding to the rewritten codes segment in the backup codes according to the position of the rewritten codes segment in the default codes;

replacing the rewritten codes segment in the default codes with the correcting codes segment.

In one embodiment, the step of correcting the default codes according to the backup codes includes:

determining a data length of the default codes;

in determination that the data length is greater than the preset threshold, comparing the backup codes and the default codes to determine a rewritten codes segment in the default codes and a correcting codes segment corresponding to the rewritten codes segment in the backup codes, and replacing the rewritten codes segment in the default codes with the correcting codes segment;

in determination that the data length is not greater than a preset threshold, adopting the backup codes to overwrite the default codes.

In one embodiment, the step of judging whether the default codes have been rewritten includes:

acquiring a first check value pre-stored in the default codes and calculating a second check value of the default codes;

determining whether the first check value matches the second check value, wherein, in determination that the first check value is inconsistent with the second check value, it is determined that the default codes have rewriting.

In one embodiment, the first check value is set at a preset position in the default codes, and the preset position is located at an end code segment in the default codes.

In one embodiment, the step of determining whether the default codes have been rewritten includes:

comparing whether the backup codes are consistent with the read default codes, in responding to a determination that the backup codes are inconsistent with the read default codes, it is determined that the read default codes are rewritten.

To realize the purpose above, the present disclosure provides a display panel, the display panel includes a memory, a timing controller, and at least one processor, default codes, a backup codes identical to the default codes, and computer executable instructions executable by at least one processor are stored in the memory, in responding to a determination that the computer executable instructions are executed by the at least one processor, one processor is caused to perform the following steps:

reading the default codes of the storage area, by the timing controller, in responding to a determination that the timing controller is powered on;

determining whether the read default codes are rewritten or not;

reading the backup codes of the storage area to take the read backup codes as the target codes in responding to a determination that the read default codes are rewritten; and, taking the read default codes as the target codes in responding to a determination that there is no rewriting of the read default codes.

To realize the purpose above, the present disclosure provides a computer readable storage medium, the computer readable storage medium has computer executable instructions executable by at least one processor, the computer executable instructions, in responding to a determination that the computer executable instructions are executed by the at least one processor, one processor is caused to perform the steps:

reading the default codes of the storage area, by the timing controller, in determination that the timing controller is powered on;

determining whether the default codes are rewritten or not;

reading the backup codes of the storage area to take the backup codes as the target codes in responding to a determination that the default codes are rewritten; and, taking the default codes as the target codes in responding to a determination that there is no rewriting of the default codes.

In the display panel, the code reading method and the computer readable storage medium provided by the present disclosure, in responding to a determination that the timing controller is powered on, the timing controller reads the default codes of the storage area, judges whether the read default codes have rewriting, and reads the backup codes if the read default codes have rewriting, so as to take the backup codes as the target codes. If there is no rewriting of the read default codes, the default codes are taken as the target codes. The timing controller may read the correct codes, thus avoiding display abnormalities on the display panel.

The realization of purposes, functional features and advantages of the present disclosure will be further explained in connection with embodiments and with reference to the accompanying drawings.

DETAILED DESCRIPTION OF THE EMBODIMENTS

It should be understood that the specific embodiments described here are intended to explain the present disclosure only and are not intended to limit the present disclosure.

A solution of the embodiment of the present disclosure is that: after a timing controller is powered on, the timing controller reads default codes of a storage area; determines whether the default codes are rewritten or not; in responding to a determination that the default codes are rewritten, the timing controller reads backup codes of the storage area and takes the backup codes as target codes; and in responding to a determination that the default codes are not rewritten, the timing controller takes the default codes as the target codes.

If there is rewriting of the default codes read by the timing controller, the backup codes are read and taken as the target codes. If there is no rewriting of the default codes read by the timing controller, the default codes are taken as the target codes. Thereby the timing controller being capable of reading the correct codes, and avoiding displaying abnormalities on the display panel.

Figure 1:
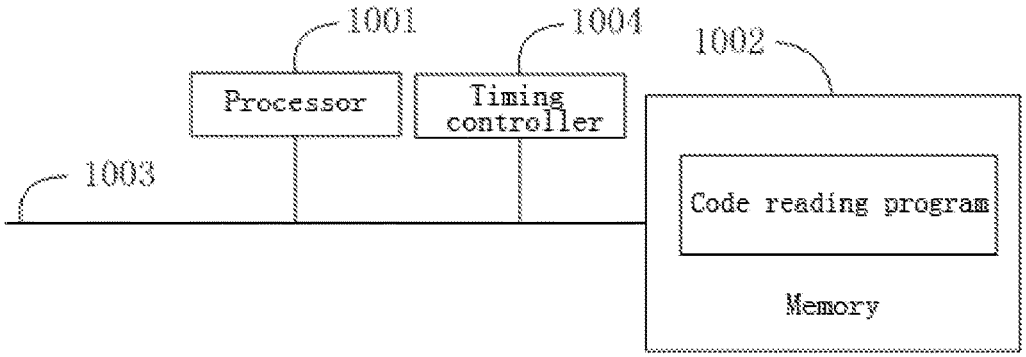
FIG. 1 is a schematic diagram of a hardware structure of a display panel accord to an embodiment of that present disclosure.

As one implementation, the display panel may be shown in FIG. 1.

The embodiments of the present disclosure relate to a display panel, which includes a processor 1001 such as a CPU, a memory 1002, a communication bus 1003, and a timing controller 1004. The communication bus 1003 is to enable connection and communication between those components.

The memory 1002 may be a high-speed RAM memory (Random Access Memory) or a stable memory (non-volatile memory), such as a magnetic disk memory. As shown in FIG. 1, the memory 1002 as a computer storage medium, can include a code reading program. The processor 1001 can invoke the code reading program stored in the memory 1002 and perform the following operations:

after the timing controller is powered on, the timing controller reading default codes of a storage area;

determining whether the default codes are rewritten or not;

in responding to a determination that the default codes are rewritten, reading backup codes of the storage area and taking the backup codes as target codes;

in responding to a determination that the default codes are not rewritten, taking the default codes as the target codes.

In one embodiment, after the step of reading backup codes of the storage area, the processor 1001 can invoke the code reading program stored in the memory 1002 and perform the following operation:

correcting the default codes according to the backup codes.

In one embodiment, the processor 1001 can invoke the code reading program stored in memory 1002 and perform the following operation:

overwriting the backup codes with the default codes.

In one embodiment, the processor 1001 can invoke the code reading program stored in memory 1002 and perform the following operations:

comparing the backup codes with the default codes to determine a rewritten code segment of the default codes;

determining a correcting code segment corresponding to the rewritten code segment in the backup codes according to a position of the rewritten code segment in the default codes;

replacing the rewritten code segment in the default codes with the correcting code segment.

In one embodiment, the processor 1001 can invoke the code reading program stored in memory 1002 and perform the following operations:

determining a data length of the default codes;

in responding to a determination that the data length is greater than a preset threshold, comparing the backup codes with the default codes to determine the rewritten code segment in the default codes and the correcting code segment corresponding to the rewritten code segment in the backup codes, and replacing the rewritten code segment in the default codes with the correcting code segment;

in responding to a determination that the data length is not greater than the preset threshold, overwriting the default codes with the backup codes.

In one embodiment, the processor 1001 can invoke the code reading program stored in memory 1002 and perform the following operations:

acquiring a first check value pre-stored in the default codes and calculating a second check value of the default codes;

determining whether the first check value matches the second check value, and in responding to a determination that the first check value is inconsistent with the second check value, determining that the default codes have been rewritten.

In one embodiment, the processor 1001 can invoke the code reading program stored in memory 1002 and perform the following operations:

the first check value being set at a preset position in the default codes, and the preset position is located at an end code segment in the default codes.

In one embodiment, the processor 1001 can invoke the code reading program stored in memory 1002 and perform the following operations:

comparing the backup codes with the default codes and determining whether the backup codes are consistent with the default codes; and in responding to a determination that the backup codes are inconsistent with the default codes, determining that the default codes have been rewritten.

According to the above scheme, after the timing controller is powered on, the timing controller reads the default codes of the storage area to judge whether the default codes have been rewritten, and if the default codes have been rewritten, the timing controller reads the backup codes to take the backup codes as the target codes. If there is no rewriting of the default codes, the default codes are taken as the target codes. The timing controller can read the correct codes, thus avoiding display abnormalities on the display panel.

Based on the above hardware architecture, an embodiment of a code reading method of the present disclosure is proposed.

Figure 2:
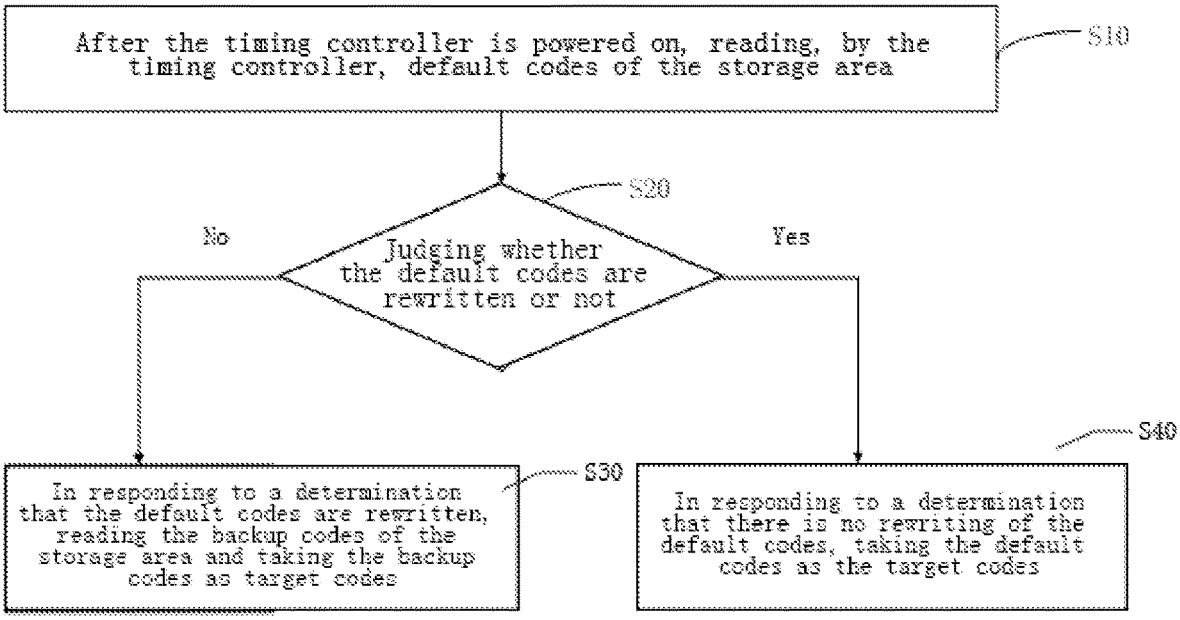
FIG. 2 is a flow diagram of an embodiment of a code reading method of the present disclosure.

FIG. 2 is an embodiment of the code reading method of the present disclosure, the code reading method includes the following steps:

S10, after the timing controller is powered on, reading, by the timing controller, default codes of the storage area.

Figure 3:
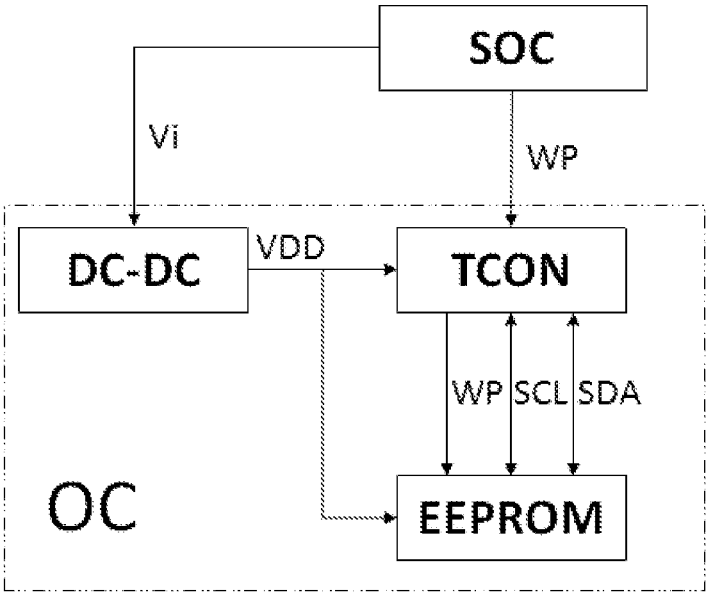
FIG. 3 is a schematic diagram showing connection relationship between a System on Chip and an Output Compare Module in the display panel of the present disclosure.

In this embodiment, if the timing controller reads the codes stored in the storage area after a power failure, there will be rewriting of the codes. Specifically, in the process of utilizing SOC (System on Chip) to light OC (Output Compare Module), the connection relationship between the SOC and the OC is shown in FIG. 3. The OC (Output Compare Module) may be arranged on a single chip microcomputer. A DC-DC (Direct Current-Direct Current Converter) in the OC converts a power supply signal vi of the SOC into a VDD (Positive Pole of Power Supply) and supplies it to the TCON (Timing Controller) and an EEPROM (Electrically Erasable Programmable Read Only Memory), in responding to a determination that large current is abnormally extracted by the OC, the SOC starts an OCP (Over Current Protection) to cut off power to the OC. After the OCP is started, WP (Write Protect in I2C Protocol), and the VDD and other signals are not controlled by the SOC, thus writing codes in the OC, garbled codes are added, and the codes are rewritten. For example, the VDD will start again without the control of the SOC after power failure, making SCL (Code Read and Write Clock in I2C Protocol) and SDA (Read and Write Data in I2C Protocol) start again while the WP is also not controlled at this moment and is in a code writing state, i.e. low level state, which normally is in a high level state of reading codes. At this time, the condition of codes writing is met, resulting in the codes being rewritten, and the written data is randomly-generated error data. In order to solve the rewriting of the codes read by the timing controller, in this embodiment, default codes and backup codes are set in the EEPROM, the backup codes are consistent with the default codes, and in responding to a determination that the timing controller reads the codes in the EEPROM, the default codes are read by default. Of course, the default codes and the backup codes may also be stored in other storage areas of the display panel, and are not limited to being stored in the EEPROM.

In the case that the timing controller is powered on again after power failure and reads the default codes of the storage area, the default codes will be overwritten. To deal with this, after the timing controller is powered on, and the timing controller reads the default codes in the storage area. it is necessary to judge whether there is overwriting of the default codes.

Step S20, judging whether the default codes are rewritten or not.

After the timing controller reads the default codes, the display panel may acquire the default codes and acquire the backup codes in the storage area. Since the default codes in the storage area are the same as the backup codes, the display panel may compare the default codes with the backup codes, that is, whether the default codes are completely consistent with the backup codes. If there exists a code segment of the default codes different from that of the backup codes, it indicates that the default codes in the storage area is overwritten. If the default codes are exactly the same as the backup codes, there is no overwriting of the default codes in the storage area. It should be noted that if the codes are rewritten, the front part of the codes are usually rewritten. Therefore, the display panel can only compare whether a front part of the default codes are consistent with a front part of the backup codes, without comparing the default codes with the backup codes in full, thus saving the computing resources of the display panel.

Step S30, in responding to a determination that the default codes are rewritten, reading the backup codes of the storage area and taking the backup codes as target codes.

Step S40, in responding to a determination that there is no rewriting of the default codes, taking the default codes as the target codes.

If the display panel determines that there is no rewriting of the default codes, the default codes are taken as the target codes, and the timing controller uses the target codes to perform corresponding operations. When the display panel determines that there is rewriting of the default codes, the backup codes are read from the storage area and taken as the target codes.

In the technical scheme provided by the embodiment, after the timing controller is powered on, the timing controller reads the default codes of the storage area to judge whether the default codes have been rewritten, and if the default codes have been rewritten, the backup codes are read and taken as the target codes. If there is no rewriting of the default codes, the default codes are taken as the target codes. The timing controller can read the correct codes, thus avoiding display abnormalities on the display panel.

Figure 4:
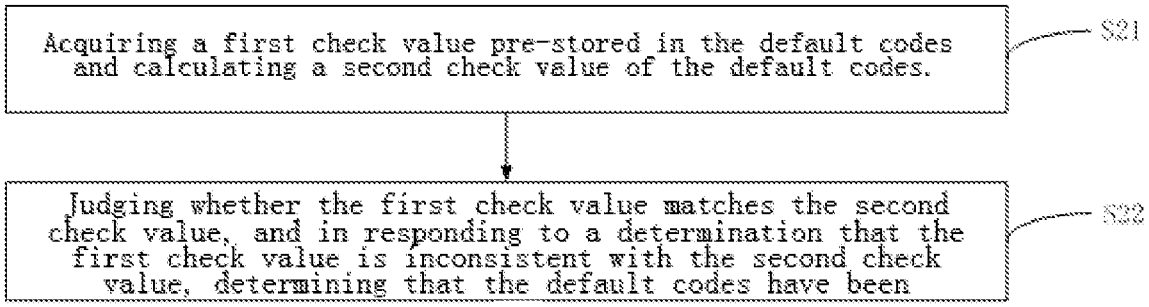
FIG. 4 is a detailed flow diagram of step S30 in FIG. 2.

FIG. 4 is a detailed flow diagram of step S20, which specifically includes:

Step S21, acquiring a first check value pre-stored in the default codes and calculating a second check value of the default codes.

Step S22, judging whether the first check value matches the second check value, and in responding to a determination that the first check value is inconsistent with the second check value, determining that the default codes have been rewritten.

In responding to a determination that the default codes are overwritten, the front part of the default codes is deemed to be overwritten by default, while the back part is deemed not be overwritten. In this regard, a check value, that is, the first check value, can be set at a preset position of the default codes. The preset position is a position at the back part of the default codes. However, the possibility of overwriting the end code segment in the default codes is the lowest, so the default position is the end code segment of the default codes. In this embodiment, there are a demarcation position between the front part and the back part, and the demarcation position is tested by a technician. The code segment before the demarcation position, namely, the code segment of the front part, has the possibility of being rewritten, while the code segment after the demarcation position, namely, the codes segment of the back part, has a very low possibility of being rewritten. The first check value may be a checksum value, and checksum is a sum of checks. When the display panel acquires the default codes, it calculates the second check value of the default codes. Specifically, the calculation of the check sum may be divided into the following steps:

1. Dividing the data of the default codes with 2 bytes to be a group, and every 2 bytes forms a 16-bit value. If there is a single byte data in the end, adding a 0 of one byte to form the 2 bytes.

2. Accumulating all 16-bit values into a 32-bit value.

3. Adding the high 16 bits and the low 16 bits of the 32-bit value to a new 32-bit value. If the new 32-bit value is greater than 0Xffff, adding the high 16 bits and the low 16 bits of the new 32-bit value.

4. Inverting a 16 bit value calculated in the previous step by bit to acquire the checksum value.

After the display panel calculates the second check value of the default codes, the pre-stored first check value is acquired from the default codes, and compared with the second check value, and it determines that the default codes have not been rewritten if the first check value is consistent with the second check value. If the first check value is inconsistent with the second check value, it determines that there is overwriting in the default codes.

In the technical scheme provided by the present embodiment, the display panel acquires the first check value in the default codes, calculates the second check value of the default codes, and compares the first check value with the second check value, so as to judge whether the default codes have been rewritten according to the comparison result.

Figure 5:
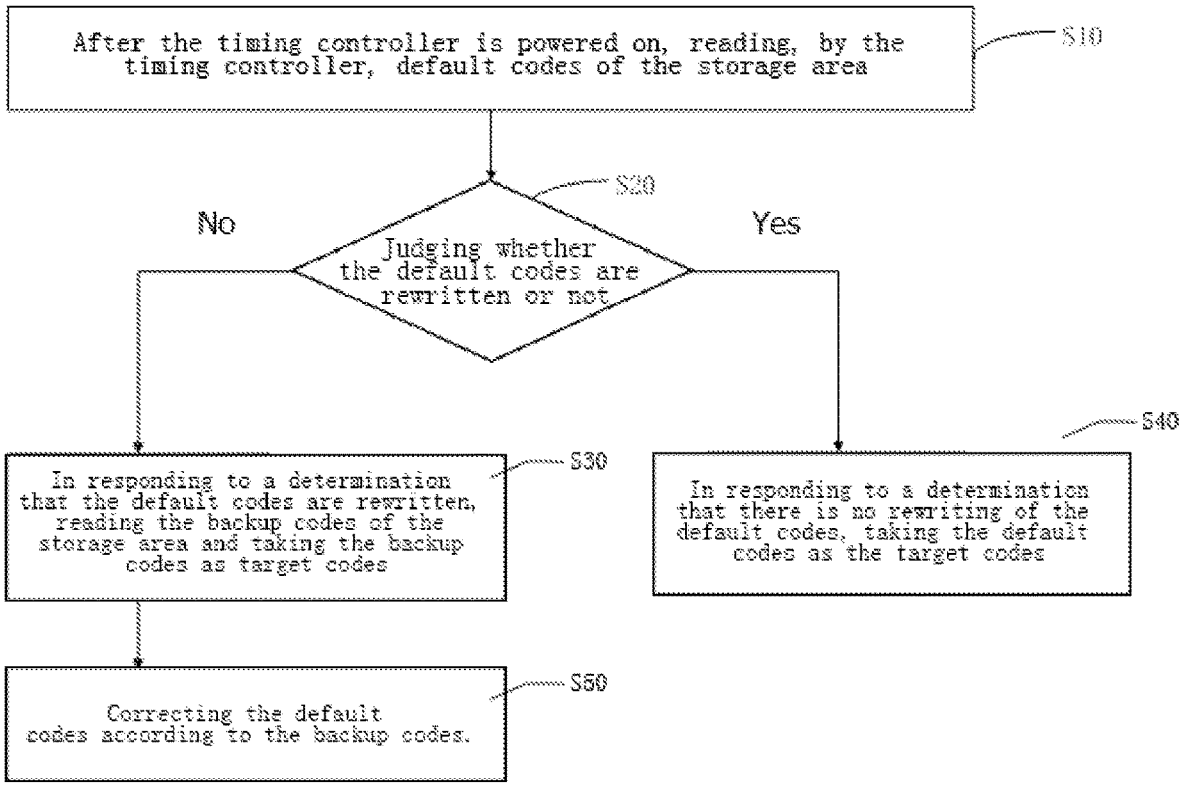
FIG. 5 is a flow diagram of another embodiment of the code reading method of the present disclosure.

FIG. 5 shows another embodiment of the code reading method of the present disclosure, after step S30, the method further includes:

Step S50, correcting the default codes according to the backup codes.

In this embodiment, after the display panel determines that the default codes have been rewritten, the display panel can determine that the default codes stored in the storage area has been rewritten, and at this time, the default codes need to be corrected. The display panel can correct the default codes according to the backup codes. Specifically, the display panel can overwrite the default codes with the backup codes. A corresponding preset position of the backup codes is also provided with the first check value, so after the backup codes overwrite the default codes to become new default codes, the display panel can still judge whether the new default codes read by the timing controller has been rewritten according to the first check value of the new default codes.

In addition, the display panel can compare the backup codes with the default codes to determine the rewritten code segment in the default codes. If the default codes have a code segment different from that of the backup codes, and the code segment is a code segment being rewritten, namely, the rewritten code segment. The display panel determines a position of the rewritten code segment in the default codes, thus determining a correcting code segment in the backup codes corresponding to the position. Finally, the rewritten code segment is replaced with the correcting codes segment, so that the default codes can be corrected, and the corrected default codes are consistent with the backup codes.

It should be noted that, when the display panel needs to correct the default codes, a data length of the default codes may be calculated. If the data length of the default codes is large, the rewritten code segment can be replaced by the correcting code segment to correct the error code segment in the default codes without copying the full text of the backup codes to fully cover the default codes, thus saving the correction time. If the data length of the default codes is small, the backup codes can be used to overwrite the default codes. The display panel takes a shorter time to copy the backup codes without comparing the default codes with the backup codes in full. Particularly, after calculating the data length of the default codes, the display panel judges whether the data length is greater than a preset threshold value, and if the data length is greater than the preset threshold value, the rewritten code segment is replaced by the correcting code segment to correct the error code segment in the default codes. If the data length is not greater than the preset threshold, the backup codes overwrite the default codes. The preset threshold may be any suitable value.

In the technical scheme provided by the present embodiment, in responding to a determination that the default codes are rewritten, the display panel corrects the default codes according to the backup codes, so that the timing controller can read the correct codes next time and avoid display abnormality on the display panel.

the present disclosure also provides a display panel, the display panel includes a memory, a timing controller, and at least one processor. The memory stores default codes, backup codes identical to the default codes, and computer executable instructions executable by the at least one processor that. when the computer executable instructions are executed by the at least one processor, the at least one processor is caused to perform the following steps:

reading, by the timing controller, the default codes of a storage area, after the timing controller is powered on;

determining whether the default codes are rewritten or not;

reading the backup codes of the storage area and taking the backup codes as target codes in responding to a determination that the default codes are rewritten;

taking the default codes as the target codes in responding to a determination that there is no rewriting of the default codes.

the present disclosure also provides a computer-readable storage medium with computer executable instructions executable by at least one processor. When the computer executable instructions are executed by the at least one processor, the at least one processor is caused to perform the following steps:

reading, by the timing controller, the default codes of a storage area after the timing controller is powered on;

determining whether the default codes are rewritten or not;

reading the backup codes of the storage area and taking the backup codes as target codes, in responding to a determination that the default codes are rewritten;

taking the default codes as the target codes, in responding to a determination that there is no rewriting of the default codes.

The above-mentioned serial numbers of embodiments of the present disclosure are for description only and do not represent the advantages and disadvantages of the embodiments.

It should be noted that, In this article, the terms "comprising", "including" or any other variation thereof are intended to encompass non-exclusive inclusion such that a process, method, article, or device that includes a series of elements includes not only those elements, but also other elements that are not explicitly listed, or also elements inherent to such a process, method, article, or device. Without further restrictions, an element defined by the statement "including a . . . " does not exclude the existence of other identical elements in the process, method, article or device that includes the element.

From the above description of embodiments, it will be apparent to those skilled in the art that the methods of the above embodiments may be implemented by means of software plus a necessary universal hardware platform, of course also by means of hardware, but in many cases the former is an optional embodiment. Based on this understanding, The technical scheme of the present disclosure may be embodied in the form of software products in essence or part that contributes to the prior art, The computer software product is stored in a storage medium (e.g., a ROM/RAM, a disk, an optical disk) as described above and includes several instructions to cause a terminal device (which may be a mobile phone, a computer, a server, a television, a network device, etc.) to perform the methods described in various embodiments of the present disclosure.

The above is only an alternative embodiment of the present disclosure and is not thereby limiting the scope of the patent of the present disclosure. Any equivalent structure or equivalent flow change made by utilizing the contents of the specification and the accompanying drawings of the present disclosure, or any direct or indirect application to other related technical fields, is likewise included in the scope of the patent protection of the present disclosure.

The invention claimed is:

1. A code reading method applied to a display panel, wherein a storage area of the display panel stores default codes and backup codes identical to the default codes, the code reading method comprises the following steps:

in determination that a timing controller is powered on, reading, by the timing controller, the default codes of the storage area;

determining whether the default codes are rewritten or not;

in determination that the default codes are rewritten, reading the backup codes of the storage area to take the backup codes as target codes; and in determination that there is no rewriting of the default codes, taking the default codes as the target codes;

wherein after the step of reading the backup codes of the storage area, the method further comprises:

determining a data length of the default codes;

in determination that the data length is greater than a preset threshold, comparing the backup codes and the default codes to determine a rewritten code segment in the default codes and a correcting code segment corresponding to the rewritten code segment in the backup codes, and replacing the rewritten code segment in the default codes with the correcting code segment without copying full text of the backup codes to fully cover the default codes, wherein the rewritten code segment is a code segment different from the correcting code segment of the default codes; and in determination that the data length is not greater than the preset threshold, adopting the backup codes to overwrite the default codes.

2. The code reading method of claim 1, wherein the step of judging whether the default codes have been rewritten comprises:

acquiring a first check value pre-stored in the default codes and calculating a second check value of the default codes; and determining whether the first check value matches the second check value, wherein, in determination that the first check value is inconsistent with the second check value, it is determined that the default codes have been rewritten.

3. The code reading method of claim 2, wherein the first check value is set at a preset position in the default codes, and the preset position is located at an end codes segment in the default codes.

4. The codes reading method of claim 1, wherein the step of determining whether the default codes have been rewritten comprises:

comparing whether the backup codes are consistent with the default codes, wherein, in determination that the backup codes are inconsistent with the default codes, it is determined that the default codes are rewritten.

5. A display panel, wherein, the display panel comprises a memory, a timing controller, and at least one processor, default codes, backup codes identical to the default codes, and computer executable instructions executable by the at least one processor are stored in the memory, when the computer executable instructions are executed by the at least one processor, the at least one processor is caused to perform the following steps:

reading the default codes of the storage area, by the timing controller, in determination that the timing controller is powered on;

determining whether the default codes are rewritten or not;

reading the backup codes of the storage area to take the backup codes as the target codes in determination that the default codes are rewritten; and taking the default codes as the target codes in determination that there is no rewriting of the default codes;

wherein after the step of reading the backup codes of the storage area, the method further comprises:

determining a data length of the default codes;

in determination that the data length is greater than a preset threshold, comparing the backup codes and the default codes to determine a rewritten code segment in the default codes and a correcting code segment corresponding to the rewritten code segment in the backup codes, and replacing the rewritten code segment in the default codes with the correcting code segment without copying full text of the backup codes to fully cover the default codes, wherein the rewritten code segment is a code segment different from the correcting code segment of the default codes; and in determination that the data length is not greater than the preset threshold, adopting the backup codes to overwrite the default codes.

6. The display panel of claim 5, wherein the step of judging whether the default codes have been rewritten comprises:

acquiring a first check value pre-stored in the default codes and calculating a second check value of the default codes; and determining whether the first check value matches the second check value, wherein, in determination that the first check value is inconsistent with the second check value, it is determined that the default codes have been rewritten.

7. A non-transitory computer readable storage medium, wherein the non-transitory computer readable storage medium has computer executable instructions executable by at least one processor, when the computer executable instructions are executed by the at least one processor, the at least one processor is caused to perform the steps:

reading default codes of the storage area, by the timing controller, in determination that the timing controller is powered on;

determining whether the default codes are rewritten or not;

reading backup codes of the storage area to take the backup codes as target codes in responding to a determination that the default codes are rewritten; and taking the default codes as the target codes in responding to a determination that there is no rewriting of the default codes;

wherein after the step of reading the backup codes of the storage area, when the computer executable instructions are executed by the at least one processor, the at least one processor is also caused to perform the steps:

determining a data length of the default codes;

in determination that the data length is greater than a preset threshold, comparing the backup codes and the default codes to determine a rewritten code segment in the default codes and a correcting codes segment corresponding to the rewritten codes segment in the backup codes, and replacing the rewritten codes segment in the default codes with the correcting codes segment without copying full text of the backup codes to fully cover the default codes, wherein the rewritten code segment is a code segment different from the correcting code segment of the default codes; and in determination that the data length is not greater than the preset threshold, adopting the backup codes to overwrite the default codes.

8. The non-transitory computer readable storage medium of claim 7, where in the step of judging whether the default codes have been rewritten comprises:

acquiring a first check value pre-stored in the default codes and calculating a second check value of the default codes; and determining whether the first check value matches the second check value, wherein, in determination that the first check value is inconsistent with the second check value, it is determined that the default codes have been rewritten.

* * * * *